United States Patent [19]

Harrop

[11] Patent Number: 5,001,819

[45] Date of Patent: Mar. 26, 1991

[54] APPARATUS FOR FORMING PERFORATED TUBES

[75] Inventor: Robert A. Harrop, Cardiff, United Kingdom

[73] Assignee: Meltog Limited, Bradford, England

[21] Appl. No.: 389,047

[22] Filed: Aug. 2, 1989

[30] Foreign Application Priority Data

Aug. 2, 1988 [GB] United Kingdom ..... 8818369

[51] Int. Cl.[5] ..... B21C 37/12

[52] U.S. Cl. ..... 29/33 D; 29/564; 72/50; 82/70.2

[58] Field of Search ..... 29/33 D, 564, 563, 33 T; 72/186, 325, 327, 176, 49, 50; 82/70.2, 92; 83/54

[56] References Cited

U.S. PATENT DOCUMENTS

| | | | |
|---|---|---|---|
| 2,136,942 | 11/1938 | Freeze | 72/50 |
| 2,282,176 | 5/1942 | Fay et al. | 72/50 |
| 2,516,817 | 7/1950 | Wernli | 82/73 |
| 3,122,115 | 2/1964 | Siegwart | 72/50 |
| 3,132,616 | 5/1964 | Hale et al. | 72/148 |
| 3,220,234 | 11/1965 | Harper | 72/50 |
| 3,268,137 | 8/1966 | Martin | 83/886 |
| 3,753,363 | 8/1973 | Frihey | 72/50 |
| 3,772,945 | 11/1973 | Varga | 82/70.2 |
| 3,982,414 | 9/1976 | Anderson | 72/50 |

FOREIGN PATENT DOCUMENTS

| | | | |
|---|---|---|---|
| 283508 | 2/1979 | Fed. Rep. of Germany | 72/49 |
| 2264607 | 10/1975 | France . | |
| 136004 | 8/1952 | Sweden | 72/50 |
| 642872 | 9/1950 | United Kingdom . | |

*Primary Examiner*—Daniel W. Howell

*Attorney, Agent, or Firm*—Klauber & Jackson

[57] ABSTRACT

The invention provides that a strip of flat steel is formed at its edges with channels which face in opposite directions and the strip is perforated between the channels. The strip is spirally coiled into tube form and a flange of one of the channels engages in the other channel and the adjacent flanges are crimped to form a helical seam in the finished tube. The tube is cut to lengths and the lengths are used in filter elements. The channel flanges are deformed prior to spiralling to facilitate the crimping and the spiralling is enhanced by the use of forming plates having edges which helically follow the curvature of the mandrel leaving a gap for the material so that the edges fit in one of the channels holding the edge of the strip captive until the strip is coiled and the captive edge is properly presented into the other channel. The machine provides a novel form of cutting head for cutting the tube to lengths, embodying a cutting tool which orbits the tube in performing the cutting.

31 Claims, 7 Drawing Sheets

APPARATUS FOR FORMING PERFORATED TUBES

The invention relates to apparatus for the formation of spiral-wound, perforated, sheet-metal tubes. Particular ones of the tubes of the invention are believed to be particularly suitable for use as cores and/or shells for fluid filters, because they exhibit considerable resistance to pressure, but may also have other applications.

In contrast to machines hitherto known for forming such tubes the present apparatus at least in its preferred form is very advantageous, being readily adapted to the formation of tubes of a wide range of diameters and lengths, from strip metal of different widths and with perforations of different dimensions.

According to one aspect of the invention there is provided apparatus for forming spiral-wound perforated tubes from sheet-metal strip comprising a generally cylindrical and cantilever-mounted mandrel, means for continuously and lengthwise perforating a sheet-metal strip and forwarding the strip to the mandrel at an angle oblique to the axis thereof, and means for rotating the mandrel about its axis.

Preferably the perforating means further comprises means for simultaneously folding back the edges of the strip respectively to opposite sides whereby the folded edges, brought together at the surface of the mandrel, can be interlocked to form a spiral seam. Accordingly, the apparatus may further comprise seaming wheel means, adjacent to the mandrel, whereby, in conjunction with the mandrel, the folded edges of the strip may be interlocked to form a spiral seam.

Preferably, the mandrel is mounted in such a fashion that the angle between its axis and the direction of the path of the strip between the perforating means and the forwarding means may be varied as required by the pitch of the winding spiral.

Preferably, the mandrel has a forming section around which the strip is formed into spiral shape, and a feed off section along which the spirally wound strip is fed, said feed off section being of lesser diameter than the forming section.

The feed off section is preferably of lesser diameter than the forming section by an amount related to the degree of shrinkage of the strip material which takes place following the heating and expansion which takes place at the forming station due to the working of the material.

The forming section and feed off section respectively are each of constant diameter and are contiguous so that a shoulder is defined between said sections. The length of the forming section is selected in relation to the width of the strip so that the overlapping edges of the strip as it is spirally wound come together in the region of the said shoulder.

The construction of the mandrel forms another aspect of the present invention, and in accordance therewith there is provided apparatus for forming spiral tubes from sheet material strip comprising a generallay cylindrical mandrel adapted to be cantilever mounted in a spiral tube forming machine having means for continuously and lengthwise forwarding the strip to the mandrel at an angle oblique to the axis thereof so that the strip is formed around the mandrel until the edges overlap to define the spirally wound tube, characterised in that the mandrel has a forming section around which the strip is formed into spiral shape, and a feed-off section along which the spirally wound strip is fed, said feed off section being of lesser diameter than the forming section.

The free end of the mandrel is preferably provided with a cutting ring, perpendicular to the axis, and the apparatus may further comprise adjustable cutting means arranged for planetary movement about the free end of the mandrel for cooperation with the cutting ring to sever the tubes.

According to a further aspect of the invention there is provided apparatus for forming spiral-wound tubes from sheet-metal strip comprising a generally cylindrical and cantilever-mounted mandrel, means for continuously and lengthwise forwarding a sheet-metal strip to the mandrel at an angle oblique to the axis thereof, and means for rotating the mandrel about its axis.

According to yet another aspect of the invention there is provided apparatus for forming spiral-wound tubes from sheet-metal strip comprising a generally cylindrical and cantilever-mounted mandrel, the free end of the mandrel being provided with a cutting ring, perpendicular to the axis, and the apparatus further comprising adjustable cutting means arranged for planetary movement about the free end of the mandrel for co-operation with the cutting ring to sever the tubes.

Embodiments of the invention will now be described by way of example and with reference to the accompanying drawings, of which:

Figure 1:
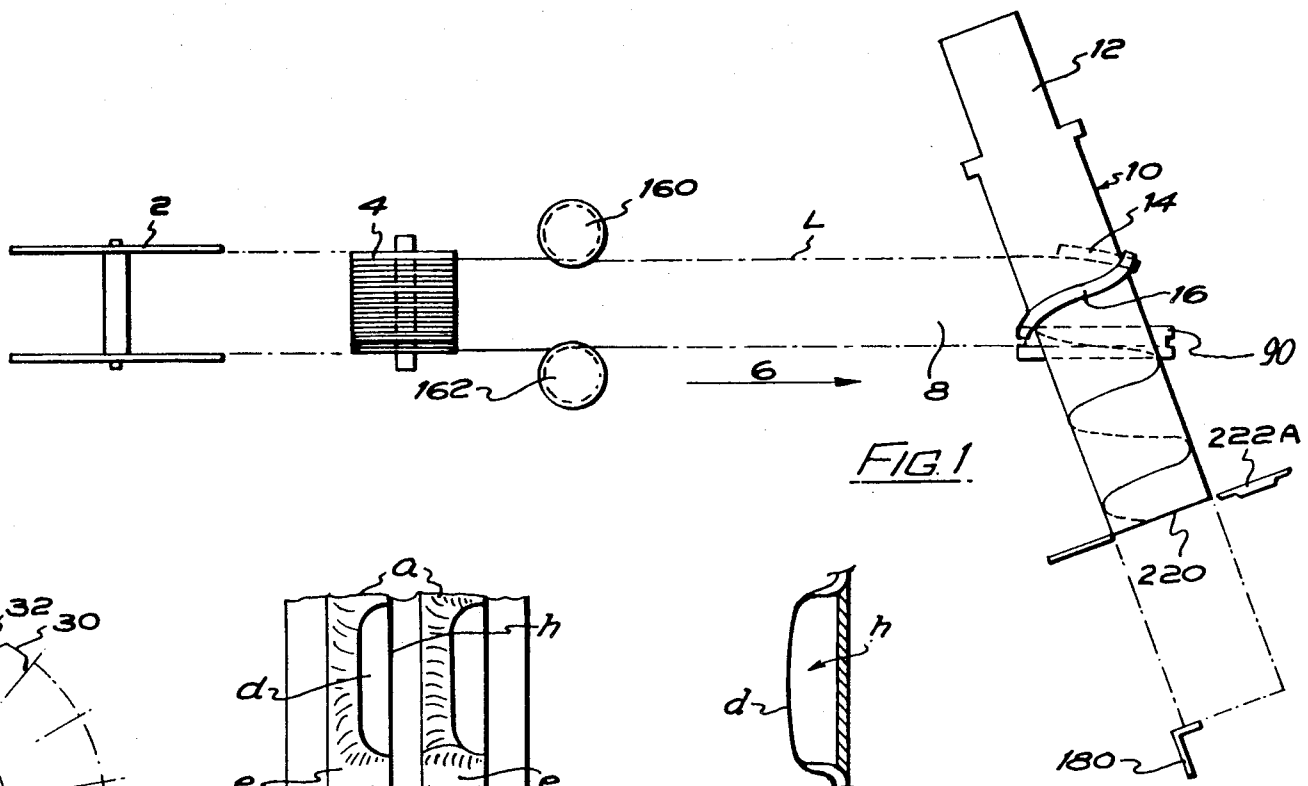
FIG. 1 is a schematic plan view of the complete apparatus for the formation of spiral-wound perforated tubes, comprising a cutting and forming unit, flange-turning and pressing rollers, mandrel, deflector plates and a cutting unit.

As indicated in the Figures, and particularly in FIG. 1, the apparatus comprises a frame (not shown) supporting a freely rotatable reel 2 for holding a roll of unperforated steel strip and, spaced therefrom in a direction perpendicular to the axis of the reel, unit 4 of a pair of co-operating forming and cutting rollers described in more detail with reference to FIG. 2.

As will be mentioned again below, the rollers of unit 4 are arranged one above the other with their axes parallel to the axis of reel 2, and the upper roller of the pair is driven by an electric motor so that if the leading edge of a roll of sheet steel strip, mounted on the reel 2, is introduced between the rollers the strip is drawn off the roll and forwarded in the direction of arrow 6.

Downstream of the forming unit 4 is a pair of flat plates 8, one above the other, defining between them a horizontal shallow guide passage substantially level with the nip between the rollers of unit 4 through which the strip is pushed by the rollers As will be mentioned below, the rollers of unit 4 bend the edges of the strip into respectively upwardly and downwardly directed flanges for the ultimate formation of an interlocking seam, and the plates 8 are thus made narrower than the strip to be employed so that the flanges project laterally of the guide passage.

Further downstream of the unit 4 the plates 8 are interrupted by a unit shown in FIG. 5A by which, as will be described in more detail below, the flanges of the strip are turned by rollers 160, 162 into pronounced hooks which later are arranged to interlock with one another.

Figure 3:
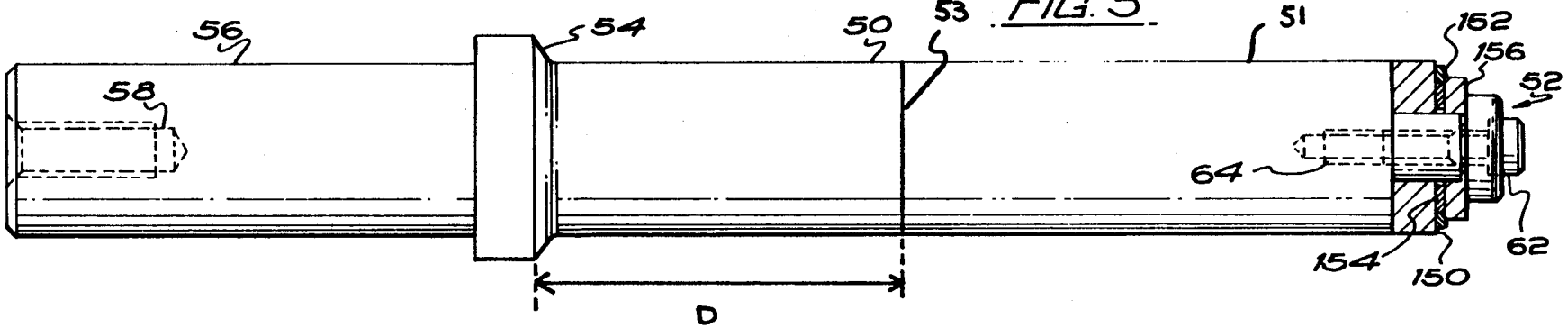
FIG. 3 shows the mandrel in side elevation.

A generally cylindrical mandrel 10, to be described in more detail with reference to FIG. 3, is arranged downstream of the plates 8 at an angle to the direction of arrow 6 and with its underside approximately level with the passage between the plates 8. The mandrel is mounted by its end 12, cantilever fashion, and for rotation about its axis by an electric motor not shown. In some embodiments, the mandrel may be stationary.

A first deflector plate 14 is arranged below the mandrel, generally skewed relative to the axis of the mandrel. As will be described in more detail below, the upper surface of the plate 14 is concave and follows the curvature of the mandrel in order to define, with the underside of the mandrel, a passage of constant depth for guiding an edge of the strip through a quarter of a turn around the mandrel.

A second deflector plate 16 having a concave lower surface is arranged over the mandrel, again at a skew relative to the mandrel axis. This defines with the mandrel surface a further constant-depth passage and is positioned to receive the edge of the strip leaving the plate 14 and direct it through a further half-turn about the mandrel.

Figure 4C:
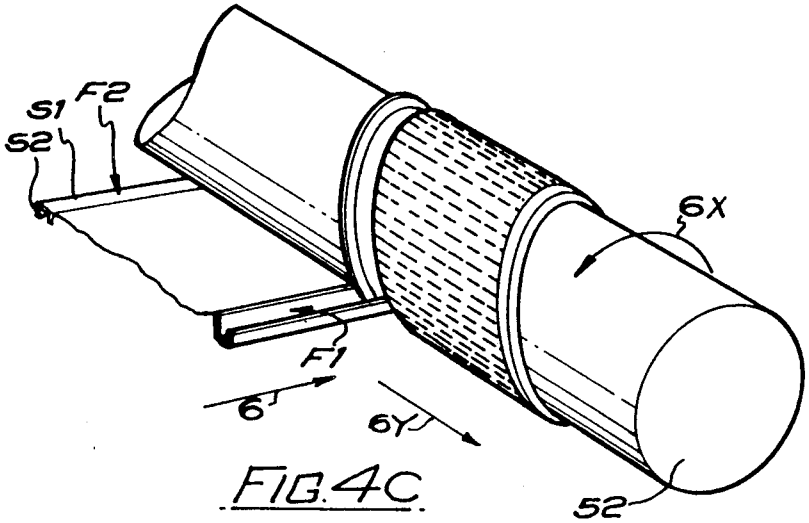
FIG. 4C shows the strip being coiled in the mandrel.
Figure 4A:
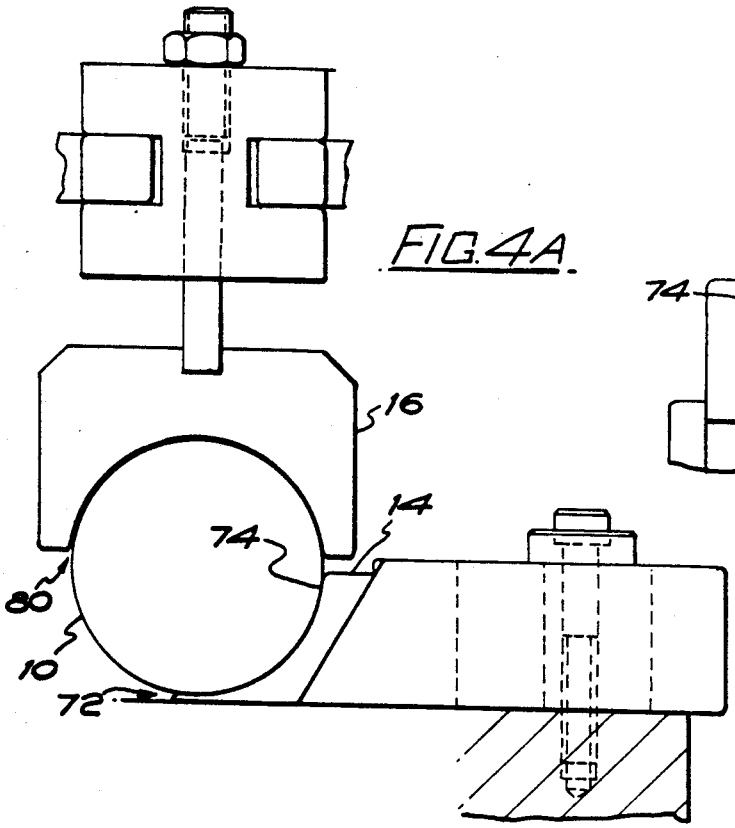
FIG. 4A is an end view of the mandrel showing the deflector plates.
Figure 4B:
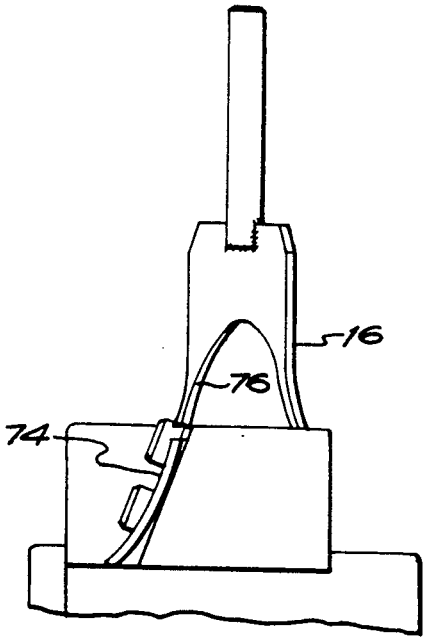
FIG. 4B is a side view of the plates with the mandrel omitted.

As shown in FIG. 1 and FIG. 4 the deflector plates 14 and 16 are curvilinear, so that their concave surfaces follow the contour of the edge of the strip as it is directed thereby spirally about the circumference of the mandrel under pressure from the rollers unit 4.

A seam-forming roller 90 is mounted below the mandrel, for rotation about its axis, so that it lies in a plane which is parallel to the direction of arrow 6, and so as to press against the surface of the mandrel. The function of the roller 90, to be described in more detail, is to lock together the respective flanged edges of the strip as shown in FIG. 5 as they come into overlapping and parallel relationship with successive length portions of the strip spiralling round the mandrel to define a tube.

The free end 220 of the mandrel will be described in more detail with reference to FIG. 6. Suffice at this point to indicate that the end 220 presents a circumferential edge which co-operates with cutters mounted for planetary motion in a frame 222A surrounding end 220 to sever the tube perpendicularly to its axis. It will be understood that once a first perpendicular severance of the tube has been made, successive actions of the cutters will produce a series of length portions of the tube being right cylinders.

Figure 2D:
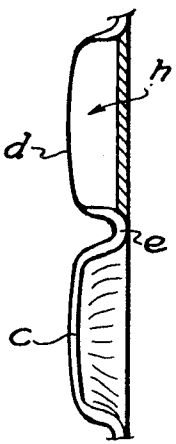
FIGS. 2C, 2D and 2E show, respectively, a plan view and longitudinal and transverse sections of perforated material.
Figure 2C:
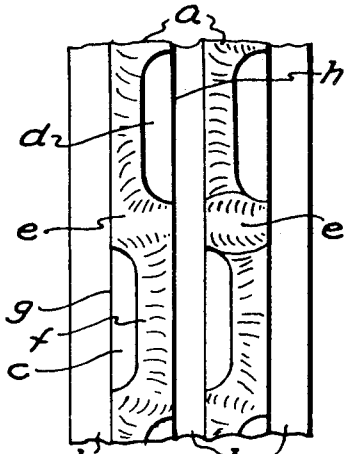
Figure 2B:
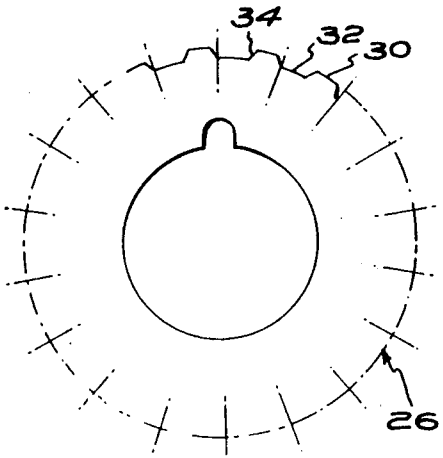
FIG. 2B shows cutting rings of the unit of FIG. 2A.
Figure 2A:
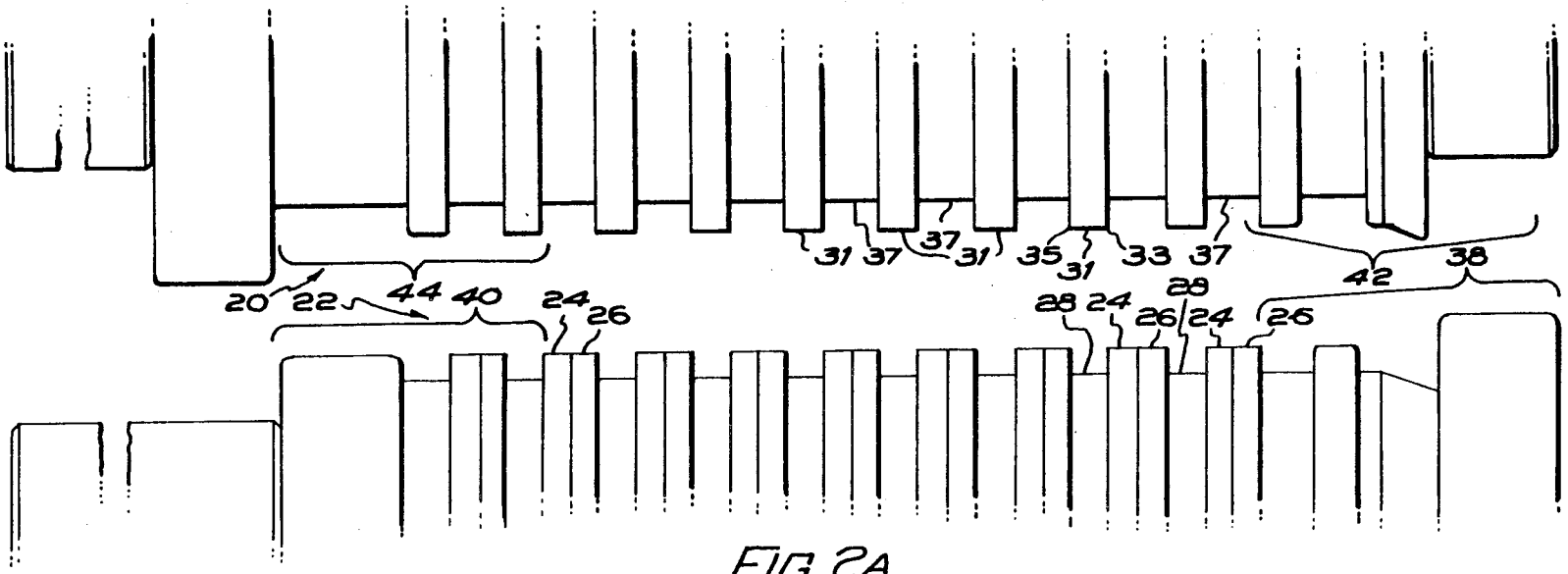
FIG. 2A is a detail of the cutting and forming unit.

The significant parts of the forming and perforating unit 4, which acts also as drive means for withdrawing the strip from reel 2 and forwarding it to the mandrel are shown in detail in FIGS. 2A–2E. FIG. 2A is a partial sectional view showing the lower portion of an upper roller 20 and upper portion of a lower roller 22 spaced apart more than in operation for the sake of simplicity. Each roller comprises a central shaft on which is mounted a series of discs of which those forming the lower roller 22 are provided with key slots to align with a key way in the lower shaft. The central portion of the lower roller 22 comprises pairs of cutting discs 24, 26, each pair being separated by a spacing disc 28 of smaller diameter FIG. 2B shows a detail of one of the cutter discs 26 which shows that its outer periphery comprises a series of teeth 30, projecting from the intermediate lands 32 which subtend a similar arc. The edges 34 of the teeth are inclined relative to the radius. Each of the cutting discs 24 is identical with disc 26 shown in FIG. 2B except that the key way is displaced so that when a pair of discs 26, 24 are arranged with their key ways in alignment, the teeth 30 of disc 26 are interspaced relative to the teeth 30 of disc 34 and in alignment with the lands 32 of disc 24.

A central portion of roller 20 comprises a series of plain rings 31 of thickness corresponding to the spacers 28 on the roller 22 and each presenting a first cutting edge 33 for cooperation with the teeth 30 of cutter 24 of one pair of cutters on the roller 22, and a second cutting edge 35 for co-operation in use with the teeth 30 of cutter 26 of an adjacent pair of cutters on roller 22. Between the cutting rings 31 are spacers 37 of thickness corresponding to the combined thickness of cutter pairs 24, 26 of the roller 22.

In practice, the axes of the rollers 20, 22 are closer than shown in FIG. 2A so that each of the cutter pairs 24, 26 enters the space between adjacent rings 31 of roller 20 so that when sheet metal is introduced between the rollers, from the reel 2, the teeth 30 of roller 26 engaging against edge 35 of ring 31 cut through the metal whilst forming a lengthwise series of rectangular depressions corresponding to the length and width of the teeth 30. At the same time the teeth 30 of the cutter 24 cooperate with edge 33 of a further ring 31 to cut the metal and form a series of rectangular depressions in staggered relationship relative to those caused by the cutter 26 and facing in the opposite direction, as will be described more fully in relation to FIG. 2F.

The result can be seen in the portion of perforated strip material shown in FIGS. 2C, 2D, 2E and 2F. In plan view, the strip presents parallel, broken channels a, running lengthwise of the strip and separated by lands b of undeformed strip material. All the channels are similar and are defined by relatively flat base portions c and d spaced by mounds e substantially in the plane of the lands b. From each end of both base portions the metal slopes upwardly to a mound e. From one side of portion c the metal presents an upward slope f to one of the lands b whilst between the other side of the base portion c and the neighbouring land is an opening g formed by the cutting of the metal. Conversely, the metal slopes downwardly from the said neighbouring land to one side of the base portion d, whilst there is an opening h between the other side of the said base portion and the first-mentioned land b. As can be seen from the transverse section, the underside of the strip presents a series of openings along one transverse line, facing one edge of the strip, whilst it can be understood that along an adjacent line a series of openings faces the other edge of the strip as will be more clearly understood from FIG. 2F.

Figure 2F:
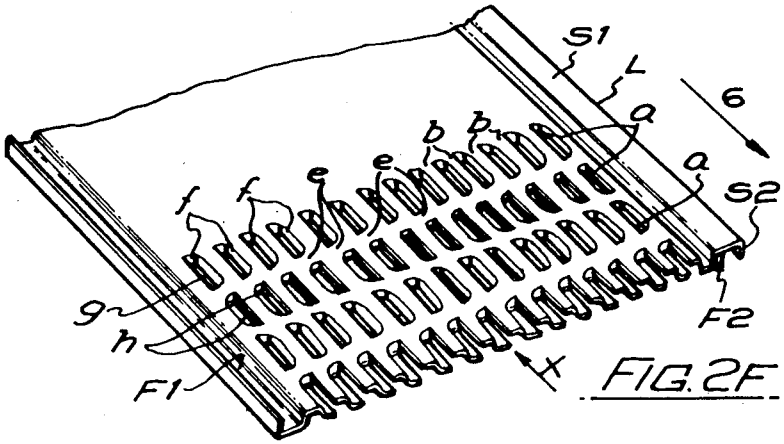
FIG. 2F shows in perspective view, a length of steel strip after it has been cut and formed, but before being spirally wound.
Figure 2E:
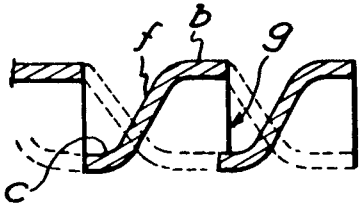

The respective ends of the roller 22 comprise a series of forming discs 38, 40 of different diameters, thicknesses and profiles, whilst roller 20 at its ends has a series of discs 42, 44 such that with the rollers set to cut and deform the strip by means of the cutter pairs 24, 26 the discs 38 and 42 at one end of the rollers combine to form one edge of the strip with an upper turned flange F1 as shown in FIGS. 2E and 2F whilst the discs 40, 44 combine to bend the other edge of the strip into a downward flange F2 as also shown in FIGS. 2E and 2F.

The mandrel 10 is shown in more detail in FIG. 3. It comprises a tube-forming section or portion 50 of substantially constant diameter extending between a shoulder flange 54 and a clearance shoulder 53, and a feed off section 51 extending between the clearance shoulder 53 and the free end 52. Remote from the free end 52 is a portion 56 by means of which the mandrel is mounted, this portion being provided with a threaded central bore 58 which in use accommodates a screw holding the mandrel in position and attaching a drive gear by which the mandrel is turned.

The free end 52 of the mandrel is formed of a series of rings secured thereto by means of bolt 62 fitted into a threaded axial bore 64 of which more detail will be given below.

FIG. 4A is a section through the mandrel perpendicular to the axis thereof. The figure shows the spiral forming deflectors 14, 16 previously mentioned. These are of for example phosphor-bronze plate, 3.5 mm thick (different materials and sizes could be used) and as previously mentioned these are skewed relative to the direction of the axis of the mandrel and indeed are not flat but are curvilinear. However as FIG. 4A shows their concave surfaces, when viewed along the axis of the mandrel, are true arcs of circles centred on the axis of the mandrel, and these arcs have diameters which are greater than that of the mandrel by somewhat more than twice the thickness of the metal plate to be formed.

In use of the apparatus, assuming that the leading end of the metal strip is cut square as shown at X in FIG. 2F and remembering that the mandrel is arranged at an angle to the axis of the forming rollers unit 4, the strip approaches the mandrel first by one of its edges where the lower deflector 14 is positioned. This edge, in the arrangement shown in FIG. 1, is the left-hand edge L as viewed from above. At this edge the flange is bent downwardly, away from the mandrel as shown in FIG. 2F. The flat portion S1 (FIG. 2F) of the strip enters the gap 72 between the lower edge of the deflector 14 and the mandrel itself with the flange S2 passing outside the deflector, and is directed in the uniform gap between the outer surface of the mandrel and concave surface 74 through a quarter of a turn about the mandrel. It will be understood that, because of the angle of the mandrel, the edge of the strip is arranged to move simultaneously lengthwise of the mandrel by about a quarter of the width of the strip. Leaving the lower deflector 14, the edge of the strip enters the corresponding gap between the mandrel and the semi-circular surface 76 of the upper deflector 16, so that the strip is deflected around a further half of the circumference of the mandrel to emerge facing downwardly at gap 80.

By this time the edge of the strip has travelled lengthwise of the mandrel by three quarters of the width of the strip and has been distorted into a circular path through three quarters of a revolution. The metal generally being of low resilience, the strip tends to follow the surface of the mandrel after leaving the gap 80 so that it completes the revolution and completes the translation lengthwise of the mandrel by the full width of the strip. Thus as seen in FIG. 4C the first mentioned edge F2 of the strip, with the outwardly bent flange at the leading end aligns with the opposite edge F1 with the formation of the first helix of a continually extending spiral. Strip feed is indicated by reference 6, mandrel rotation by reference 6X and spiral feed along the mandrel by 6Y. Throughout the helix forming action, the mandrel itself is rotated in the direction of and at approximately the same speed as the spiralling strip.

Figure 5E:
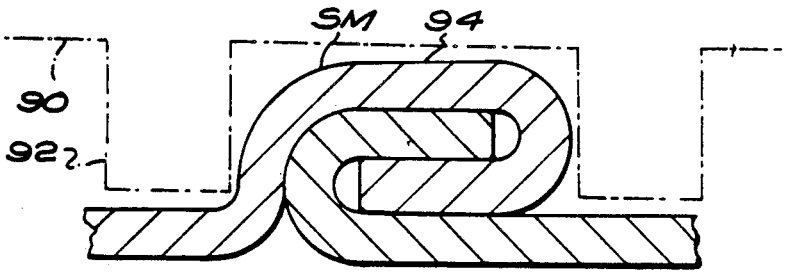
FIG. 5E shows interlocked flanges after pressing.
Figure 5D:
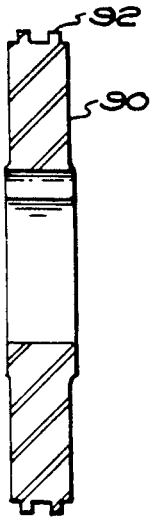
FIG. 5D is a sectional view of the flange pressing roller.

As the respective edges Fl, F2 come together, the flanges shown in FIG. 2E, respectively turned towards and away from the mandrel, inter-engage. The roller 90 shown in FIGS. 5D and 5E is arranged at this point to rotate in and by surface contact with the mandrel. The roller 90 is provided with two parallel circumferential ribs 92. The spacing and projection of the ribs 92 are such that they span the inter-engaged flanges and press them against the mandrel so that they are pressed into the tight seam SM shown in FIGS. 5E and 7 where the peripheral surface of the roller 90 is shown in chain dotted lines.

Once the first helix of the spiral tube has been formed as described above, each successive length portion of strip drawn from the roll, perforated and fed forwardly by the rollers 20, 22 adds to the length of the spiral tube so that the leading edge of the formed tube advances towards and eventually beyond the free end 52 of the mandrel.

The shoulder 53 is formed in the mandrel 10 at a distance D from the flange 54, such distance corresponding to the width of the strip measured in a direction inclined to the strip by an amount equal to the angle at which the strip is fed to the mandrel so that in fact the shoulder 53 will lie in the vicinity of the spiralling strip where the edge flanges F1 and F2 overlap and interengage as shown in FIG. 4C and also in fact where the roller 90 is located.

As the strip is fed to the mandrel and is spiralled as described above, metal in fact due to the working of same tends to heat up, especially if as is anticipated the metal is fed through the machine at high speed, and this heating up effect causes the metal slightly to expand. When the metal subsequently has the opportunity to cool down, for example when it reaches the feed off section 51 of the mandrel, the metal tends to contract, and if the feed off section 51 were to be of the same diameter as the forming section 50, the spirally wound tube could tend to bind on the feed off section 51 leading to breakdown of the machine. Therefore, the feed off section 51 is made a sufficient clearance amount less in diameter than section 50 hence the presence of the shoulder 53. This clearance amount is quite small, and for example can be in the order of a fraction of a millimeter sufficient to avoid the binding effect described above.

The heating of the material is due to the working of same, especially as the location of the flange F2 in relation to the guides 14 and 16 is such that the flange is held captive by the said guides whilst spiral forming is taking place.

Figure 5A:
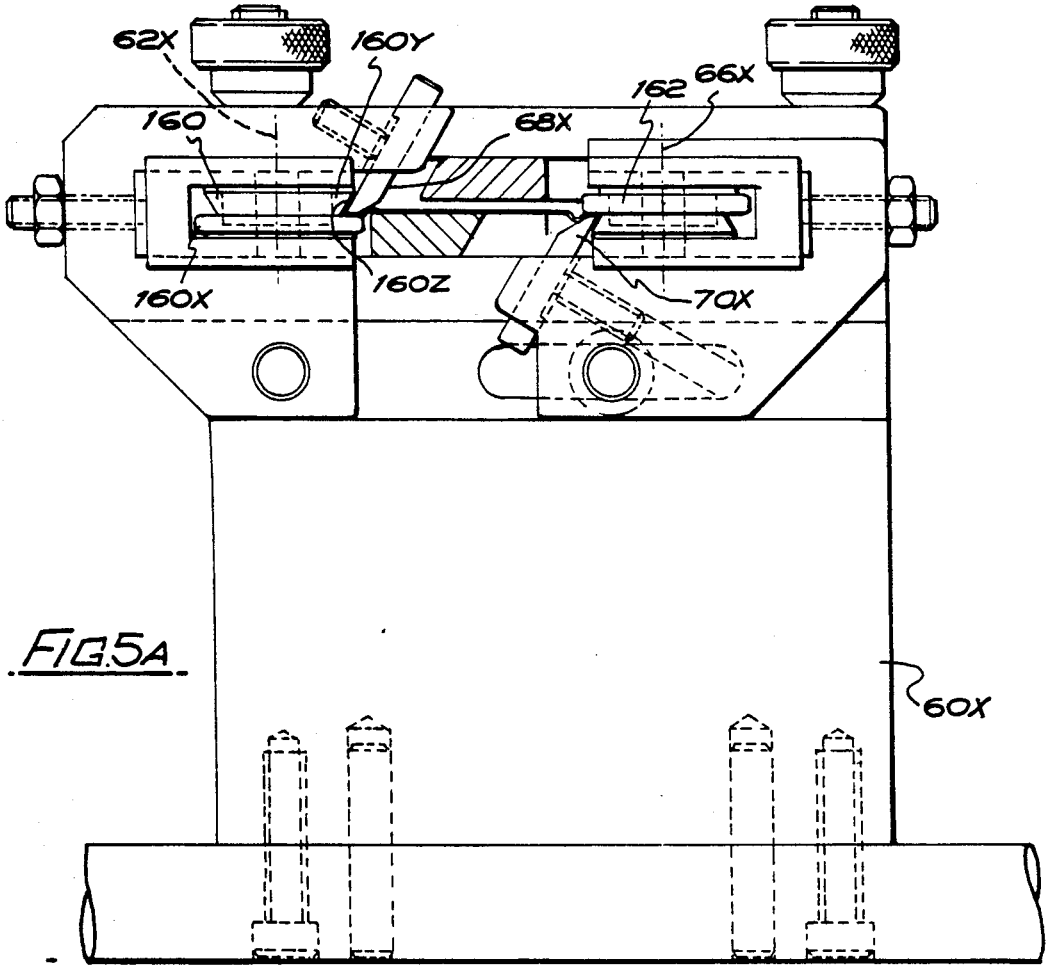
FIG. 5A is an end elevation of a unit carrying the flange-turning rollers.
Figure 5B:
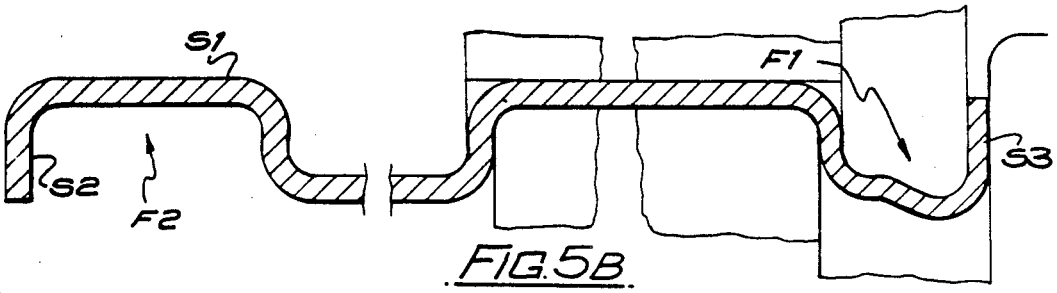
FIGS. 5B and 5C show the flanges respectively before and after turning.
Figure 5C:
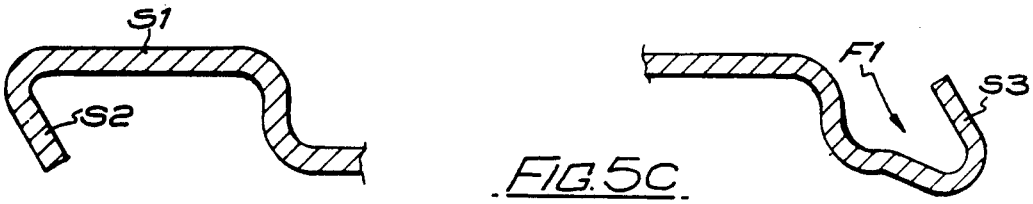

Referring to FIGS. 5A, 5B and 5C, these figures serve to show how the channels formed in the edges of the strip by the forming rollers of unit 4 are subsequently distorted further in order to form hook like formations from said channels.

FIG. 5A shows the apparatus in which the forming rollers 160 and 162 are mounted, and this apparatus comprises a stand 60X supporting said rollers 160 and 162 for rotation about vertical axes 62X and 66X. The rollers 160 and 162 are of identical construction, except that they face in opposite directions. Each roller comprises a disc portion 160X and a frustoconical portion 160Y between which is formed a shoulder 160Z into which the edge of the previously formed strip is deflected by means of a jig finger 68X. The jig finger 70X which cooperates with roller 162 is oppositely positioned as shown in relation to finger 68X because the respective channels F1 and F2 as shown clearly in FIG. 2F face in opposite directions.

FIG. 5B shows the profile shape of the channels F1 and F2 as the strip emerges from the forming unit 4, whilst FIG. 5C shows the extra deformation to which the channels have been subjected in passing through the apparatus carrying the rollers 160 and 162. It will be seen from FIG. 5 that the edge flange S2 has been hooked inwardly to a greater extent, and similarly with the flange S3 of the channel F1 so that the flanges S2 and S3 form interhooking elements when the strip is wound as previously described with reference to FIG. 4C.

Referring now to series 6 of the figures, these show the cutoff unit 22A. This comprises a cam ring 100, shown in front elevation in FIG. 6A and in transverse section in FIG. 6B and a rotary unit 102 shown in front elevation and transverse section respectively in FIGS. 6C and 6D.

Figure 6B:
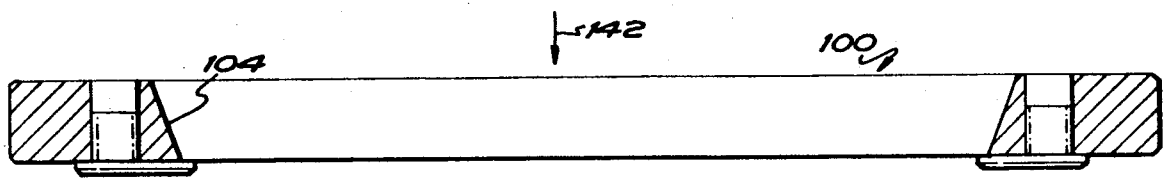
FIG. 6B is a sectional view of the cam ring.
Figure 6D:
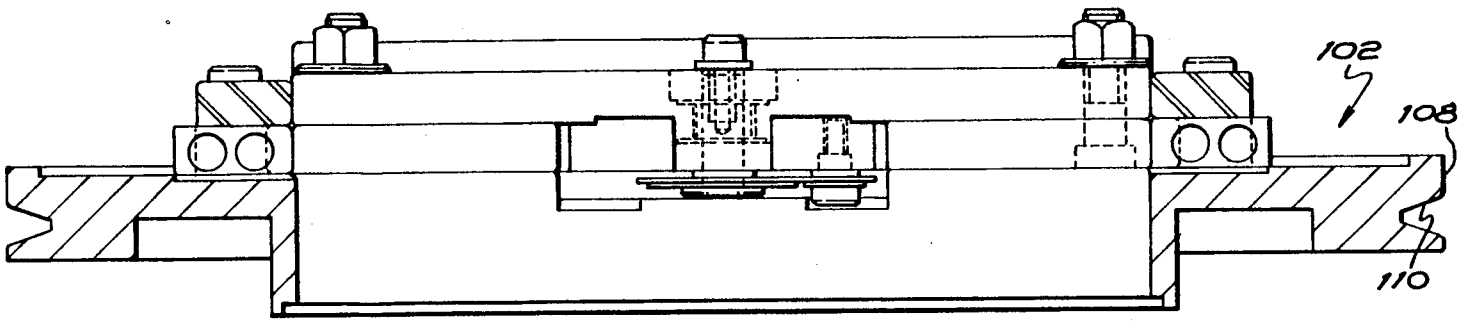
FIG. 6D is a sectional view of the rotary unit.
Figure 6E:
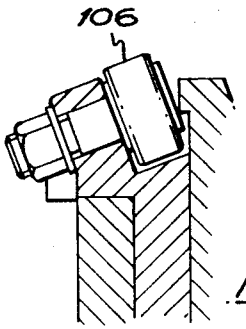
FIG. 6E is a detail of a mounting roller of the rotary unit.
Figure 6A:
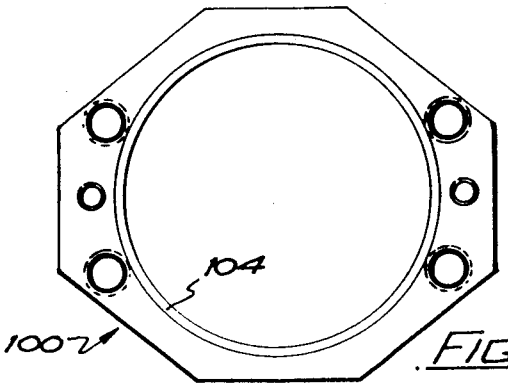
FIG. 6A is a plan view of a cam ring for the cutting unit.

The support ring 100 is rigidly mounted by conventional means perpendicularly to the axis of the mandrel at its free end 52. As shown in FIGS. 6A and 6B the ring 100 is generally annular in shape, and the centre of the annulus lies on the axis of the mandrel. The inner circumferential surface 104 of ring 100 is bevelled and treated to provide a hardened face which provides a bearing for the rotary unit 102 which contacts the bevelled face 104 by angled rollers 106.

The rotary unit 102 is itself generally annular, its outer periphery 108 having a V-groove 110 to accommodate a V-belt for the rotation co-axially with ring 100 thereof during the cutting action. The unit further comprises a cutting wheel 112, mounted for rotation about an axis parallel to that of the annulus itself and projecting inwardly of the inner circumferential surface 116 of the annulus. The function of the cutter wheel 112 is to co-operate with the end 52 of the mandrel to sever the formed tube perpendicularly to its axis.

The cutting wheel 112 is mounted in a member 124 which is adjustably mounted, by means of bolts 120 passing through slots 122 to a sliding member 140. Similarly an opposed pressure wheel 114 is mounted in a member 118 which is similarly adjustably mounted in a slide 130. The adjustability of the members 118 and 124 by virtue of the slots 122 and bolts 120 provides that the cut-off unit can be applied to tubes formed on mandrels of very different diameters because by releasing the bolts 120 and sliding the member 118 upwardly and the member 124 downwardly as shown in the FIG. 6C, the cutting wheel 112 and the pressure wheel 114 can be brought closer to the axis of the annulus and thus closer to the surface of the mandrel. In all cases, however, the bolts 120 are tightened with members 118 and 124 short of a position where the cutter 112 and wheel 114 bear upon the tube, so that except when cutting is to take place the tube, forming on the mandrel, can project outwardly from the free end 52 of the mandrel through the centre of the rotary device and the support ring 100.

The slide members 130, 140 are slidable relative to vertical guide strips 126, downward movement of slide member 140 and upward movement of slide member 130 being against the pressure of springs 144. In addition to supporting the members 118 and 124, the slide members also support, on axes inclined to the rotary axis of the member 102, the wheels 106 to which reference has already been made and which are shown in more detail in FIG. 6E.

When it is required that the tube shall be cut, which may be indicated by the end of the tube contacting the detector device 180 shown in FIG. 1, feed of strip to the mandrel is halted. The rotary unit 102 is then displaced axially in the direction of arrow 142 (FIG. 6B) so that the rollers 106 which had ridden about the larger diameter end of surface 104 move progressively to the smaller diameter end of that surface displacing the respective slide members 130, 140 inwardly against the pressure of springs 144. If the positions of the members 118 and 124 have been correctly adjusted, this further movement is sufficient to bring the cutting wheels 112, and the pressure wheel 114 into engagement with the tube and beyond the tube into cutting engagement with a corresponding cutting edge provided at the end 52 of the mandrel at diametrically opposed positions. The rotary member 102 is now rotated on member 100 and the rotary movement of the rotary member 102 ensures that the cutting action continues around the periphery of the tube.

Figure 6C:
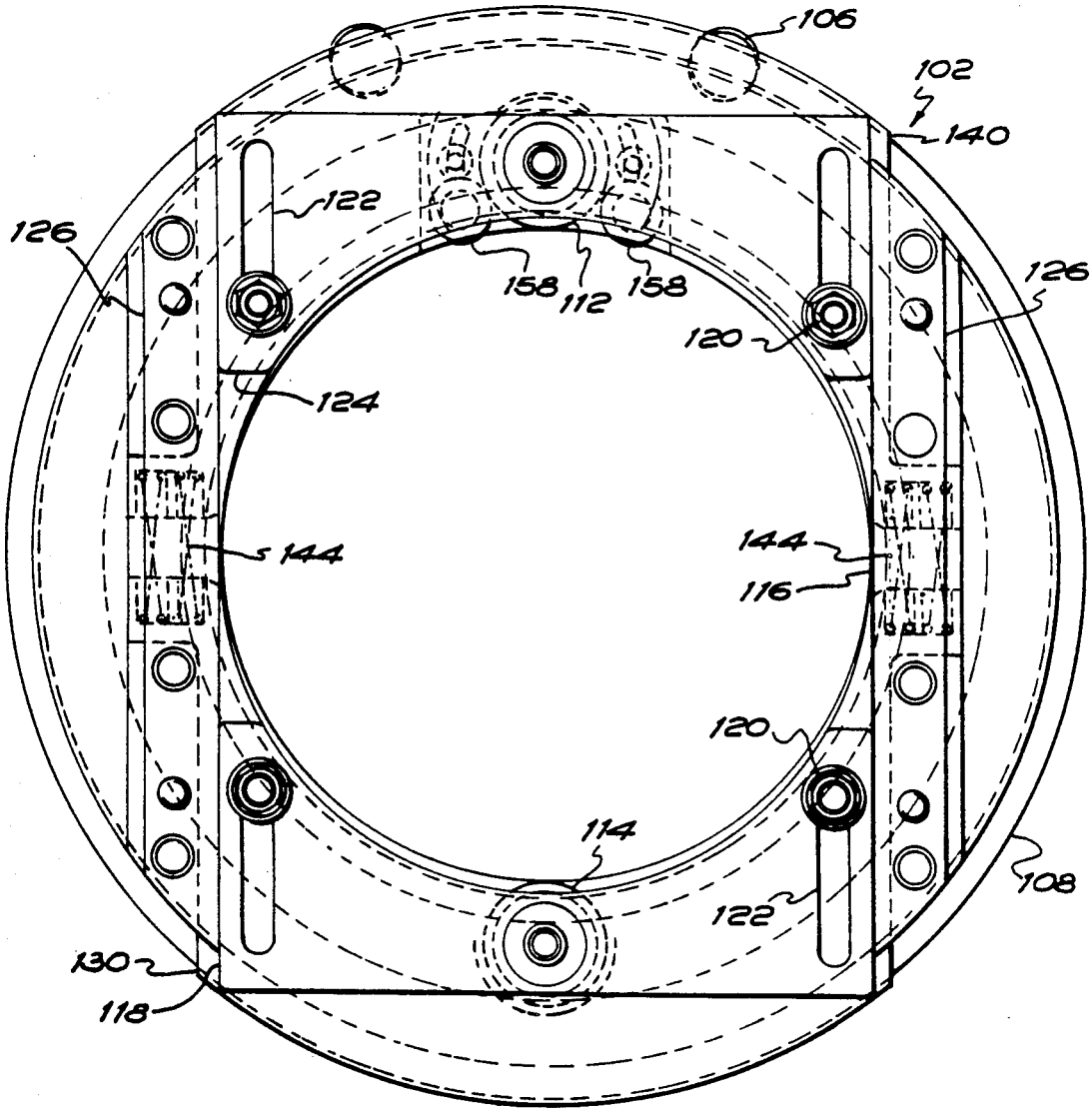
FIG. 6C is a plan view of a rotary unit of the cutting unit.

When the pressure in the direction of arrow 142 is released, the springs 144 urge the sliding members 130, 140 respectively downardly and upwardly as viewed in FIG. 6C, so that the cutter wheels 112 and the pressure wheels disengage from the tube and the rollers 106, bearing on the inclined surface 104, displace the rotary unit 102 in the direction opposite to that of arrow 142.

Reference to FIG. 3 will show that the free end 52 of the mandrel presents a hardened cutting edge 150 for co-operation with the cutting roller 112. A thin annulus 152 is arranged about the disc 154 and is held in place by a disc 156. The edge of the annulus 152 co-operates during the cutting of the tube with the rollers 158 mounted respectively before and after the cutting roller 112 in respect of the rotation of the rotary unit 102, and this co-operation provides for a slight inward distortion of the tube material at each side of the line of severance.

Figure 7:
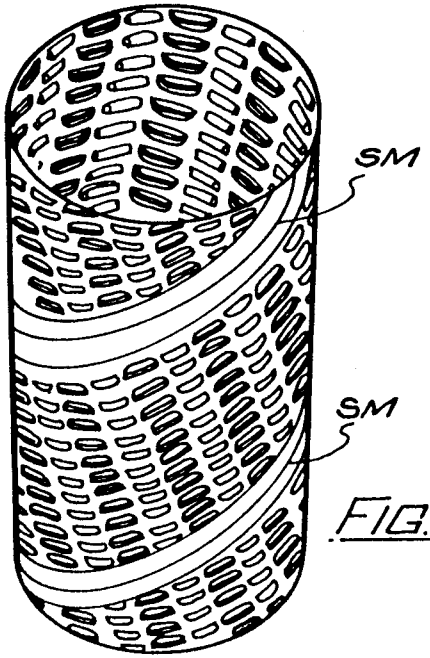
FIG. 7 shows in perspective view, a finished length of spirally wound tube.

FIG. 7 shows a length of spirally wound tube, which forms a core or sheath for a filter cartridge. A neat and effective product results, with the helical seam SM forming a means firmly connecting the coils of the spiral.

The present invention provides a number of aspects in the machinery described, and also in the finished product, and any one or more of these aspects constitutes the present invention.

I claim:

1. Apparatus for forming a spirally wound tube from a flat strip of material having a lengthwise direction and opposite edges, said apparatus comprising:

(a) feeding means for feeding the material in the lengthwise direction thereof;

(b) forming means for forming, at each edge of said fed material, at least one of an upwardly directed channel with a free edge flange and a downwardly directed channel with a free edge flange;

(c) a curved forming mandrel having an outer surface and an axis; and (d) plate guide means for supplying said fed material to the mandrel at an angle to the axis of said mandrel such that said material is caused to spiral around said mandrel with the flange at one edge of the material being directed into the channel at the opposite edge of the material upon completion of one spiral around the mandrel, said plate guide means including a guide edge which follows the curvature of the mandrel and which defines a gap with said mandrel for receiving one said channel, to cause said material to spiral around said mandrel and to retain the respective edge of the material to the outer surface of the mandrel.

2. Apparatus according to claim 1, including:

(e) means for clenching together the free edge flanges of the respective edges of the material when spirally wound to form a spiral seam.

3. Apparatus according to claim 2, wherein the said means for clenching comprises a pressure roller lying tangentially to the mandrel surface and comprising a groove in which the interfitting channels are received.

4. Apparatus according to any preceding claim, including:

(f) means for deforming said free edge flanges to turn same inwardly, said means for deforming being located, having regard to the direction of feed of the material, between the means for forming and the mandrel.

5. Apparatus according to claim 4, wherein said means for deforming comprises a shaping jig through which the material is passed.

6. Apparatus according to claim 5, wherein said shaping jig comprises shaping edging rollers and complimentary shaping fingers.

7. Apparatus according to claim 1, wherein said means for forming comprises complimentary forming rolls defining a nip through which the material is passed.

8. Apparatus according to claim 7, wherein said rolls have formations to form perforations in the material between said channels.

9. Apparatus according to claim 8, wherein said rolls comprise discs having cutting teeth, the teeth of adjacent discs being staggered relative to each other.

10. Apparatus according to claim 1, wherein said plate guide means comprises a quadrant plate having a portion of the guide edge subtending an angle of 90° of the mandrel and extending helically thereof, and a diametrical guide plate having a portion of the guide edge subtending an angle of 180° of the mandrel and extending helically thereof.

11. Apparatus according to claim 1, including (e) cutting means for cutting the spirally wound tube into lengths.

12. Apparatus according to claim 11, wherein said cutting means comprises a cutting head, a mounting for said cutting head, rotation support means enabling the cutting head to be rotated on the mounting and around the axis of the mandrel enabling said cutting means to effect cutting of the tube into lengths whilst the tube lies on the axis of the mandrel and drive means for rotating the cutting means.

13. Apparatus according to claim 12, wherein said mandrel comprises a cutting edge positioned to co-operate with said cutting means for the cutting of the tube.

14. Apparatus according to claim 12, wherein said cutting head comprises a pair of semi-annular components which cooperate to form an annular component through the centres of which the tube to be cut passes, spring means urging the components apart, said cutting head being mounted on one of the components, and said rotation support means comprises cam wheels carried by the said components, and said mounting defines a frusto conical cam track engaged by said wheels, and including means for urging the cutting head axially of the mandrel to cause the wheels to move towards the smaller diameter end of the cam track to cause the cutting means to move into cutting engagement with the tube.

15. Apparatus according to claim 14, wherein the other of said components comprises a pressure wheel adapted to engage the tube at a diametrically opposite position to the cutting head when cutting of the tube is taking place.

16. Apparatus according to claim 1, wherein the mandrel has a forming section around which the strip is formed into spiral shape, and a feed off section along which the spirally wound strip is fed, said feed off section being of lesser diameter than the forming section.

17. Apparatus according to claim 16, wherein the feed off section is of lesser diameter than the forming section by an amount less than a millimeter related to the degree of shrinkage of the strip material which takes place following the heating and expansion which takes place at the forming station due to the working of the material.

18. Apparatus according to claim 17, wherein the forming section and feed off section respectively are each of constant diameter and are continguous so that a shoulder is defined between said sections.

19. Apparatus according to claim 18, wherein the length of the forming section is selected in relation to the width of the strip so that overlapping edges of the strip as it is spirally wound come together in the region of the said shoulder.

20. Apparatus for forming spirally wound tube from a flat strip of material having a lengthwise direction and opposite edges, comprising:

(a) means for feeding the strip in the lengthwise direction thereof;

(b) a mandrel;

(c) means for spirally winding the strip around the mandrel;

(d) means for connecting adjacent strip edges wound around the mandrel to form the spirally wound tube; and (e) means for working the material before it is wound around the mandrel, said means for working comprising complimentary forming rolls defining a nip through which the material passes, said rolls having formations to form channels at the edges of the material and said rolls having discs with cutting teeth, the teeth of adjacent discs being staggered relative to each other.

21. Apparatus for forming a spirally wound tube from a flat strip of material having a lengthwise direction and opposite edges, comprising:

(a) means for feeding the strip in the lengthwise direction thereof, (b) a mandrel having a cutting edge, (c) means for spirally winding the strip around the mandrel, (d) means for connecting adjacent strip edges wound around the mandrel to form the spirally wound tube, and (e) cutting means for cutting the spirally wound tube into lengths, said cutting means cooperating with said cutting edge for the cutting of the tube.

22. Apparatus according to claim 21, wherein said cutting means comprises a cutting head, a mounting for said cutting head, rotation support means enabling the cutting head to be rotated on the mounting and around the axis of the mandrel enabling said cutting means to effect cutting of the tube into lengths whilst the tube lies on the axis of the mandrel and drive means for rotating the cutting means.

23. Apparatus according to claim 22, wherein said cutting head comprises a pair of semi-annular components which cooperate to form an annular component through the centres of which the tube to be cut passes, spring means urging the components apart, said cutting head being mounted on one of the components, and said rotation support means comprises cam wheels carried by the said components, and said mounting defines a frusto conical cam track engaged by said wheels, and including means for urging the cutting head axially of the mandrel to cause the wheels to move towards the smaller diameter end of the cam track to cause the cutting means to move into cutting engagement with the tube.

24. Apparatus according to claim 23, wherein the other of said components comprises a pressure wheel adapted to engage the tube at a diametrically opposite position to the cutting head when cutting of the tube is taking place.

25. Apparatus for forming a spirally wound tube from a flat strip of material having a lengthwise direction and opposite edges, said apparatus comprising:

(a) feeding means for feeding the material in the lengthwise direction thereof;

(b) forming means for forming, at each edge of said fed material, at least one of an upwardly directed channel with a free edge flange and a downwardly directed channel with a free edge flange, said forming means including complimentary forming rolls defining a nip through which the material is passed;

(c) a curved forming mandrel having an outer surface and an axis; and (d) plate guide means for supplying said fed material to the mandrel at an angle to the axis of said mandrel such that said material is caused to spiral around said mandrel with the flange at one edge of the material being directed into the channel at the opposite edge of the material upon completion of one spiral around the mandrel, said plate guide means including a guide edge which follows the curvature of the mandrel and which defines a gap with said mandrel for receiving one said channel, to cause said material to spiral around said mandrel and to retain the respective edge of the material to the outer surface of the mandrel.

26. Apparatus according to claim 25, wherein said rolls have formations to form perforations in the material between said channels.

27. Apparatus according to claim 26, wherein said rolls includes discs having cutting teeth, the teeth of adjacent discs being staggered relative to each other.

28. Apparatus for forming spiral tubes from sheet material strip comprising a generally cylindrical mandrel adapted to be cantilever mounted in a spiral tube forming machine having means for continuously and lengthwise forwarding the strip to the mandrel at an angle oblique to the axis thereof so that the strip is formed around the mandrel until edges of the strip overlap to define the spirally wound tube, characterized in that the mandrel has a forming section around which the strip is formed into a spiral shape, and a feed off section along which the spirally wound strip is fed, the forming section and feed off section respectively each being of a constant diameter and contiguous so that a shoulder is defined between said sections.

29. Apparatus according to claim 28, wherein the feed off section is of lesser diameter than the forming section by an amount less than a millimeter related to the degree of shrinkage of the strip material which takes place following the heating and expansion which takes place at the forming station due to the working of the material.

30. Apparatus according to any of claims 28 or 29, wherein the length of the forming section is selected in relation to the width of the strip so that the overlapping edges of the strip as it is spirally wound come together in the region of the said shoulder.

31. Apparatus for forming a spirally wound tube from a flat strip of material having a lengthwise direction and opposite edges, said apparatus comprising:

(a) feeding means for feeding the material in the lengthwise direction thereof;

(b) forming means for forming, at each edge of said fed material, at least one of an upwardly directed channel with a free edge flange and a downwardly directed channel with a free edge flange;

(c) a curved forming mandrel having an outer surface and an axis;

(d) plate guide means for supplying said fed material to the mandrel at an angle to the axis of said mandrel such that said material is caused to spiral around said mandrel with the flange at one edge of the material being directed into the channel at the opposite edge of the material upon completion of one spiral around the mandrel, said plate guide means including a guide edge which follows the curvature of the mandrel and which defines a gap with said mandrel for receiving one said channel to cause said material to spiral around said mandrel and to retain the respective edge of the material to the outer surface of the mandrel; and (e) deforming means for deforming said free edge flanges inwardly, said deforming means being located between said forming means and the mandrel with respect to said lengthwise direction.

* * * * *